US010364116B2

(12) United States Patent
Hatada

(10) Patent No.: US 10,364,116 B2
(45) Date of Patent: Jul. 30, 2019

(54) MEDIUM FEEDING APPARATUS AND CONTROL METHOD FOR MEDIUM FEEDING APPARATUS

(71) Applicant: SEIKO EPSON CORPORATION, Tokyo (JP)

(72) Inventor: Kenji Hatada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 205 days.

(21) Appl. No.: 15/459,229

(22) Filed: Mar. 15, 2017

(65) Prior Publication Data

US 2017/0267478 A1 Sep. 21, 2017

(30) Foreign Application Priority Data

Mar. 16, 2016 (JP) ..... 2016-052974

(51) Int. Cl.
*B65H 23/00* (2006.01)
*B41J 13/00* (2006.01)
*B65H 20/02* (2006.01)

(52) U.S. Cl.
CPC ..... *B65H 23/005* (2013.01); *B41J 13/0009* (2013.01); *B65H 20/02* (2013.01)

(58) Field of Classification Search
CPC ..... B65H 23/005; B65H 20/02; B41J 13/0009
See application file for complete search history.

(56) References Cited

U.S. PATENT DOCUMENTS 8,157,459 B2 * 4/2012 Hatada ..... B41J 15/04 400/582
9,731,920 B2 * 8/2017 Noguchi ..... B65H 18/10
2009/0057997 A1 * 3/2009 Hatada ..... B41J 13/0009 271/270
2009/0245912 A1 * 10/2009 Igarashi ..... B41J 11/003 400/618
2009/0269119 A1 * 10/2009 Hatada ..... B41J 11/001 400/618
2009/0297244 A1 * 12/2009 Hatada ..... B41J 11/42 400/582
2013/0042807 A1 * 2/2013 Noguchi ..... B65H 18/10 118/500

FOREIGN PATENT DOCUMENTS

JP 2009-255496 11/2009
JP 2013-193307 9/2013

* cited by examiner

*Primary Examiner* — Sang K Kim
(74) *Attorney, Agent, or Firm* — Workman Nydegger

(57) ABSTRACT

There is provided a medium feeding apparatus including a feeding roller that feeds a printing medium, a roll holding portion that holds a roll body on which the printing medium is wound, an intermediate roller that pulls out the printing medium from the roll body and feeds the printing medium on the feeding roller, a rotation amount detection portion that detects an amount of rotation of the intermediate roller and an amount of rotation of the roll body when the printing medium is fed by the intermediate roller, and a controller that calculates a roll diameter of the roll body based on the detected amount of rotation of the intermediate roller and the detected amount of rotation of the roll body.

5 Claims, 9 Drawing Sheets

MEDIUM FEEDING APPARATUS AND CONTROL METHOD FOR MEDIUM FEEDING APPARATUS

BACKGROUND

1. Technical Field

The present invention relates to a medium feeding apparatus that feeds a medium such as a printing medium and to a control method for the medium feeding apparatus.

2. Related Art

In the related art, there is known a printing apparatus provided with a transport roller that transports a printing medium in a transport direction, a carriage driving mechanism that mounts a head and forms a dot on the printing medium that is transported by the transport roller, and a roll body driving mechanism that rotatably drives a roll body while holding the roll body (refer to JP-A-2013-193307). In the printing apparatus, when the transport roller is driven, an amount of rotation of the transport roller and an amount of rotation of the roll body are detected, and based thereon, a roll diameter of the roll body is calculated. Then, based on the calculated roll diameter, driving of the transport roller or control of the roll body driving mechanism is performed, and tension control and the like of the printing medium is performed during printing.

However, in the configuration of the related art, it is necessary to detect each of the amounts of rotation by performing a special feeding operation (detection feeding) after the roll body is set. That is, an operation is necessary to detect each of the amounts of rotation by feeding forward a fixed amount of printing media after the roll body is set, and thereafter, feeding in reverse the fed-forward printing medium. Therefore, after the roll body is set, a problem occurs in that the start of printing is delayed.

SUMMARY

An advantage of some aspects of the invention is to provide a medium feeding apparatus that has a simple configuration and that is able to easily obtain a roll diameter without performing a special feeding operation and a control method for the medium feeding apparatus.

According to an aspect of the invention, there is provided a medium feeding apparatus including a feeding roller that feeds a medium, a holding portion that holds a roll body on which the medium is wound, an intermediate roller that pulls out the medium from the roll body and feeds the medium on the feeding roller, a rotation amount detection portion that detects an amount of rotation of the intermediate roller and an amount of rotation of the roll body when the medium is fed by the intermediate roller, and a roll diameter calculation portion that calculates a roll diameter of the roll body based on the detected amount of rotation of the intermediate roller and the detected amount of rotation of the roll body.

In this case, it is preferable that the rotation amount detection portion detect the amount of rotation of the intermediate roller and the amount of rotation of the roll body during a tip end feeding operation in which a tip end of the medium that is set on the intermediate roller is fed on the feeding roller.

According to another aspect of the invention, there is provided a control method for the medium feeding apparatus including a feeding roller that feeds a medium, a holding portion that holds a roll body on which the medium is wound, and an intermediate roller that pulls out the medium from the roll body and feeds the medium on the feeding roller, the method including detecting an amount of rotation of the intermediate roller and an amount of rotation of the roll body when the medium is fed by the intermediate roller, and calculating a roll diameter of the roll body based on the detected amount of rotation of the intermediate roller and the detected amount of rotation of the roll body.

According to this configuration, the intermediate roller is provided between the feeding roller and the roll body, and the roll diameter is calculated using the amount of rotation of the intermediate roller. Therefore, it is possible to detect the amount of rotation of the intermediate roller and the amount of rotation of the roll body during a tip end feeding operation in which a tip end of the medium that is set on the intermediate roller is fed on the feeding roller, and it is possible to calculate the roll diameter. Consequently, it is possible to easily obtain a roll diameter with a simple configuration without performing a special feeding operation.

In the medium feeding apparatus, it is preferable that the rotation amount detection portion detect the amount of rotation of the intermediate roller and the amount of rotation of the roll body from a point in time at which feeding by the intermediate roller starts and the roll body is rotated by a fixed amount.

According to the configuration, it is possible to detect the amount of rotation of the intermediate roller and the amount of rotation of the roll body after slack of the medium between the intermediate roller and the roll body or backlash around the roll body are eliminated. Therefore, it is possible to accurately calculate the roll diameter.

In this case, when the roll body is not rotated by a fixed amount during the tip end feeding operation and when the medium is fed by the feeding roller, it is preferable that the rotation amount detection portion detect the amount of rotation of the feeding roller and the amount of rotation of the roll body, and the roll diameter calculation portion calculates the roll diameter based on the detected amount of rotation of the feeding roller and the detected amount of rotation of the roll body.

According to the configuration, in a case where it is not possible to calculate the roll diameter without the roll body rotating by a fixed amount during the tip end feeding operation, the roll diameter is calculated based on the amount of rotation of the feeding roller and the roll body. Thereby, it is possible to reliably obtain the roll diameter.

Meanwhile, when the medium is fed by the intermediate roller, it is preferable to further provide a roll driving portion that rotatably drives the roll body.

According to the configuration, since it is possible to assist feeding by the intermediate roller by using the roll driving portion, it is possible to reduce a load that is applied to the intermediate roller during feeding by the intermediate roller. Consequently, it is possible to suppress slippage of the medium on the intermediate roller, and it is possible to more accurately detect the roll diameter.

BRIEF DESCRIPTION OF THE DRAWINGS

The invention will be described with reference to the accompanying drawings, wherein like numbers reference like elements.

DESCRIPTION OF EXEMPLARY EMBODIMENTS

A medium feeding apparatus and a control method for the medium feeding apparatus according to an embodiment of the invention will be described below with reference to the attached drawings. In the present embodiment, there is exemplified a printing apparatus to which the medium feeding apparatus and the control method for the medium feeding apparatus of the invention are applied. The printing apparatus performs printing using an ink jet method on a fed printing medium while pulling out and feeding the printing medium (medium) from a roll body. The roll body that is set to the printing apparatus winds an elongated printing medium in a roll shape by making use of a cylindrical core. In addition, the printing medium is recording paper, a film, cloth, and the like. In particular, the printing apparatus has a configuration in which it is possible to easily obtain a roll diameter of the roll body with a simple configuration without performing a special feeding operation.

Figure 1:
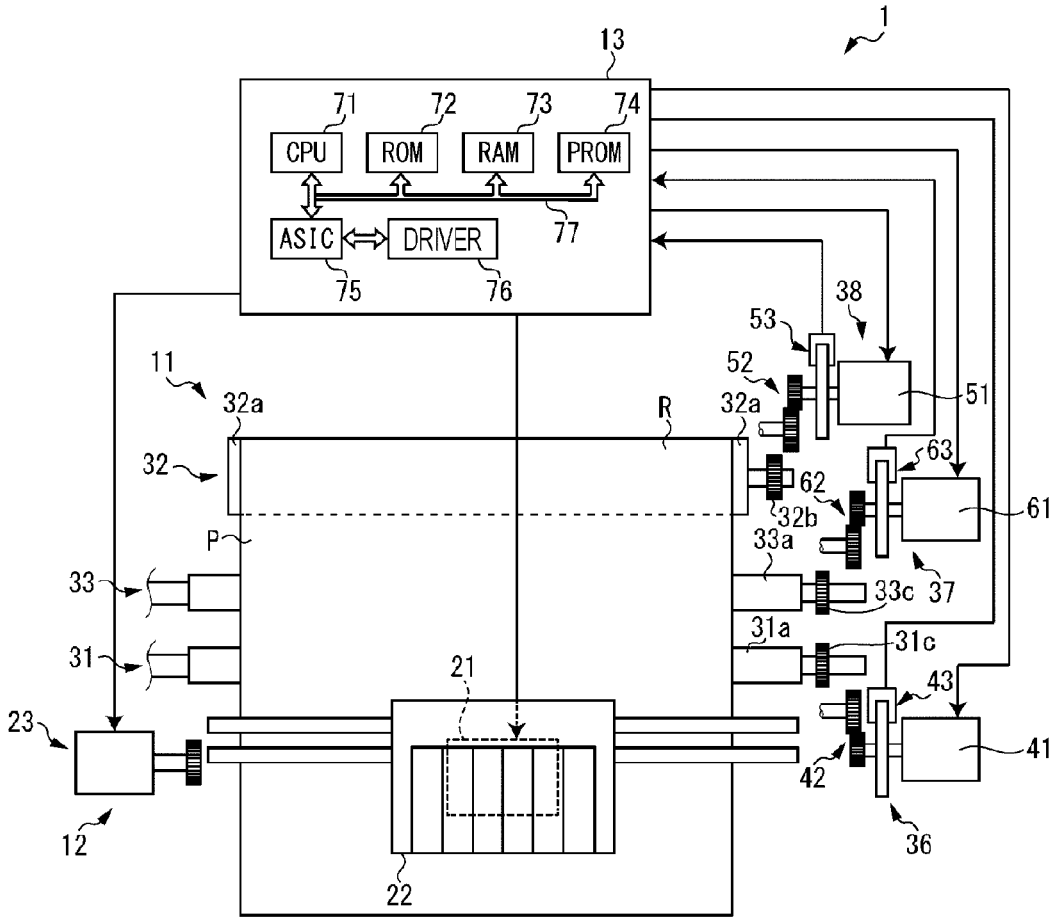
FIG. 1 is a plan view illustrating an outline configuration of a printing apparatus according to an embodiment of the invention.
Figure 2:
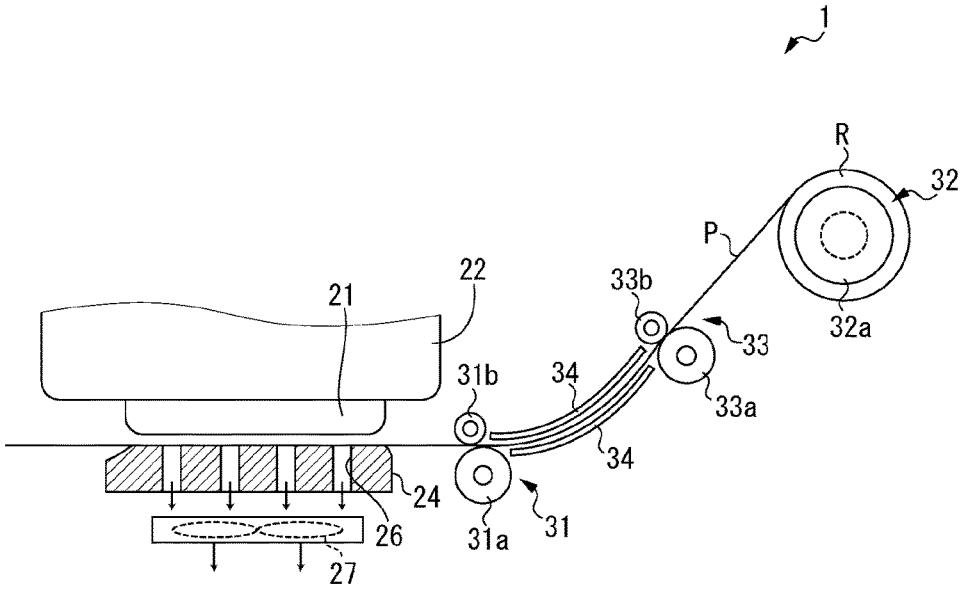
FIG. 2 is a side view illustrating an outline configuration of the printing apparatus.

As shown in FIGS. 1 and 2, a printing apparatus 1 is provided with a medium feeding mechanism 11 that feeds a printing medium P in a paper feeding direction, a printing mechanism 12 that performs printing on the printing medium P that is fed by the medium feeding mechanism 11, and a controller 13 (roll diameter calculation portion) that controls the medium feeding mechanism 11 and the printing mechanism 12. The printing apparatus 1 performs printing by a serial printing method on the printing medium P by repeating a line feeding operation performed by the medium feeding mechanism 11 and a printing operation performed by the printing mechanism 12. Note that, the "medium feeding apparatus" is formed of the medium feeding mechanism 11 and the controller 13.

The printing mechanism 12 performs printing on the printing medium P that is fed by a feeding roller 31, which will be described later, and is provided with an ink jet printing head 21, a carriage 22 on which the printing head 21 is mounted, a reciprocating mechanism 23 that reciprocates the printing head 21 via the carriage 22, and a platen 24 that faces the printing head 21. Note that, the printing mechanism 12 may be constituted to be provided with a plurality of printing heads 21 and may be constituted to be provided with only one printing head 21.

The printing head 21 has a nozzle row (omitted from the drawings) that extends in the paper feeding direction of the printing medium P by using the medium feeding mechanism 11 and that discharges ink from a plurality of discharge nozzles of the nozzle row. Meanwhile, the reciprocating mechanism 23 reciprocates the printing head 21 in a direction intersecting the paper feeding direction. Then, the printing mechanism 12 performs the printing operation on the printing medium P by driving the printing head 21 while moving the printing head 21 forward or backward by moving the reciprocating mechanism 23.

Meanwhile, a plurality of suction holes 26 are formed in the platen 24 so as to vertically pass through the platen 24. In addition, a suction fan 27 is provided below the platen 24. Then, negative pressure is set within the suction hole 26 and the printing medium P is suctioned and held on the platen 24 by the suction fan 27 operating. In the present embodiment, the printing operation is performed on the printing medium P in a state in which the printing medium P is suctioned and held on the platen 24.

The medium feeding mechanism 11 is provided with a feeding roller 31 that performs paper feeding of the printing medium P, a roll holding portion 32 (holding portion) that holds a roll body R on which the printing medium P is wound, and an intermediate roller 33 that pulls out the printing medium P from the roll body R that is held by the roll holding portion 32 and feeds the printing medium P on the feeding roller 31. In addition, the medium feeding mechanism 11 is provided with a feeding roller driving portion 36 that drives the feeding roller 31, an intermediate roll driving portion 37 that drives the intermediate roller 33, and a roll driving portion 38 that rotatably drives the roll body R. Note that, a pair of guide members 34 that are guided when the tip end of the printing medium P which is set on the intermediate roller 33 is fed to the feeding roller 31 is disposed between the feeding roller 31 and the intermediate roller 33.

The feeding roller 31 is constituted by a nip roller that consists of a driving roller 31*a* and a driven roller 31*b*. That is, the driving roller 31*a* and the driven roller 31*b* of the feeding roller 31 rotatably feed while interposing the printing medium P therebetween. In addition, the driving roller 31*a* has a feeding input gear 31*c* to which a motive force from the feeding roller driving portion 36 is applied.

The feeding roller driving portion 36 is provided with a feeding motor 41 that is a source of a motive force, a feeding gear row 42 that transfers the motive force of the feeding motor 41 to the feeding roller 31, and a feeding rotation detection portion 43 that detects a rotation position and a rotation direction of the feeding roller 31. The feeding motor 41 is, for example, a DC motor. In addition, the feeding gear row 42 is connected to the feeding input gear 31*c* that is provided on the driving roller 31*a* of the feeding roller 31. Then, the driven roller 31*b* rotates in accordance with the driving roller 31*a* rotating due to the motive force from the feeding motor 41 being transferred to the feeding input gear 31*c* via the feeding gear row 42. In this manner, the feeding roller 31 is rotatably driven by the motive force of the feeding motor 41.

The feeding rotation detection portion 43 detects the rotation position and the rotation direction of the driving roller 31*a* of the feeding roller 31. In detail, the feeding rotation detection portion 43 is constituted by a rotary encoder that is provided with a disc-shape scale which is provided on an output shaft of the feeding motor 41, and a photo interrupter. That is, the feeding rotation detection portion 43 detects the rotation position and the rotation direction of the driving roller 31*a* of the feeding roller 31 by detecting the rotation position and the rotation direction of the output shaft of the feeding motor 41.

The roll holding portion 32 is provided with a pair of rotating holders 32*a* that hold the roll body R, and a holder support portion (omitted from the drawings) that holds a pair of rotating holders 32*a* so as to respectively rotate freely. The pair of rotating holders 32*a* are respectively inserted at both ends of the core of the roll body R and hold the roll body R from both sides. In addition, one member of the pair of rotating holders 32*a* has a roll input gear 32*b* to which the motive force from the roll driving portion 38 is applied.

The roll driving portion 38 is provided with a roll motor 51 that is a source of the motive force, a roll gear row 52 that transfers the motive force of the roll motor 51 to the rotating holder 32*a*, and a roll rotation detection portion 53 that detects the rotation position and the rotation direction of the roll body R. The roll motor 51 is, for example, a DC motor. In addition, the roll gear row 52 is connected to the roll input gear 32*b* of the rotating holder 32*a* that holds the roll body R. The rotating holder 32*a* that is provided with the roll input gear 32*b* rotates and the roll body R that is held by the rotating holder 32*a* rotates due to the motive force from the roll motor 51 being transferred to the roll input gear 32*b* via the roll gear row 52. In this manner, the roll body R is rotatably driven due to the motive force of the roll motor 51.

The roll rotation detection portion 53 detects the rotation position and the rotation direction of the roll body R. In detail, the roll rotation detection portion 53 is constituted by a rotary encoder that is provided with a disc-shape scale which is provided on an output shaft of the roll motor 51, and a photo interrupter. That is, the roll rotation detection portion 53 detects the rotation position and the rotation direction of the roll body R by detecting the rotation position and the rotation direction of the output shaft of the roll motor 51.

The intermediate roller 33 is constituted by a nip roller that consists of a driving roller 33*a* and a driven roller 33*b*. That is, the driving roller 33*a* and the driven roller 33*b* of the intermediate roller 33 rotatably feed while interposing the printing medium P therebetween. In addition, the driving roller 33*a* has an intermediate input gear 33*c* to which the motive force from the feeding roller driving portion 36 is applied. Note that, the intermediate roller 33 is constituted such that it is possible to set the tip end of the printing medium P that is pulled out from the roll body R when setting the roll body R.

The intermediate roll driving portion 37 is provided with an intermediate motor 61 that is a source of motive force, an intermediate gear row 62 that transfers the motive force of the intermediate motor 61 to the intermediate roller 33, and an intermediate rotation detection portion 63 that detects the rotation position and the rotation direction of the intermediate roller 33. The intermediate motor 61 is, for example, a DC motor. In addition, the intermediate gear row 62 is connected to the intermediate input gear 33*c* that is provided on the driving roller 33*a* of the intermediate roller 33. Then, the driven roller 33*b* rotates accompanying the driving roller 33*a* rotating due to the motive force from the intermediate motor 61 being transferred to the intermediate input gear via the intermediate gear row 62. In this manner, the intermediate roller 33 rotatably drives due to the motive force of the intermediate motor 61.

The intermediate rotation detection portion 63 detects the rotation position and the rotation direction of the driving roller 33*a* of the intermediate roller 33. In detail, the intermediate rotation detection portion 63 is constituted by a rotary encoder that is provided with a disc shape scale which is provided on an output shaft of the intermediate motor 61, and a photo interrupter. That is, the intermediate rotation detection portion 63 detects the rotation position and the rotation direction of the driving roller 33*a* of the intermediate roller 33 by detecting the rotation position and the rotation direction of the output shaft of the intermediate motor 61.

The controller 13 collectively controls each part of the printing apparatus 1. In detail, the controller 13 is provided with a central processing unit (CPU) 71, a read only memory (ROM) 72, a random access memory (RAM) 73, a programmable ROM (PROM) 74, an application specific integrated circuit (ASIC) 75, a motor driver 76, and a bus 77. In addition, each pulse signal is input from the feeding rotation detection portion 43, the roll rotation detection portion 53, and the intermediate rotation detection portion 63 to the controller 13.

In the printing apparatus 1 that is constituted in the manner described above, a printing image is formed by alternately repeating a printing operation (main scanning) by the printing mechanism 12, and a line feeding operation (sub-scanning) in which the printing medium P is fed by a printing width of the printing mechanism 12 using the medium feeding mechanism 11 when a print job execution command is received.

Figure 3:
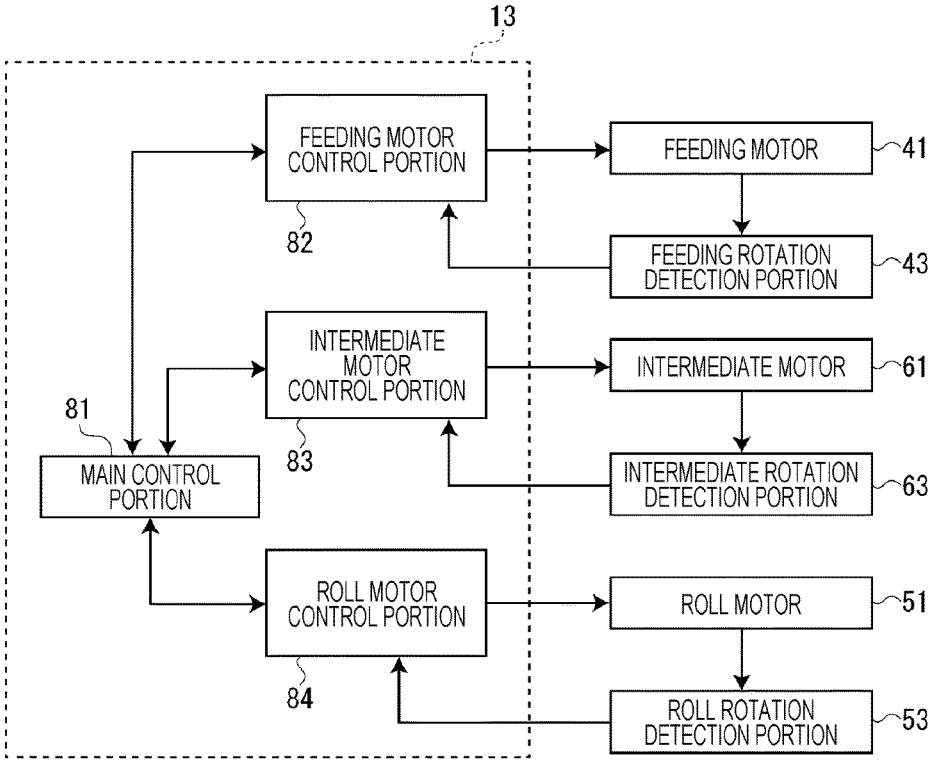
FIG. 3 is a block diagram illustrating a functional configuration of a controller.

Next, a functional configuration of the controller 13 will be described with reference to FIG. 3. As shown in FIG. 3, the controller 13 is provided with a main control portion 81, a feeding motor control portion 82, an intermediate motor control portion 83, and a roll motor control portion 84. Each functional part is realized in cooperation of hardware that constitutes the controller 13 and software that is stored in a memory such as the ROM 72.

The main control portion 81 gives a command to the feeding motor control portion 82, the intermediate motor control portion 83, and the roll motor control portion 84. The main control portion 81 is able to give a command to the feeding motor control portion 82, the intermediate motor control portion 83, and the roll motor control portion 84 such that the feeding motor 41, the intermediate motor 61 and the roll motor 51 are driven independently from each other or such the feeding motor 41, the intermediate motor 61 and the roll motor 51 synchronously drive.

The feeding motor control portion 82 drivably controls the feeding motor 41 in pulse width modulation (PWM) control via the motor driver 76. The feeding motor control portion 82 outputs the duty value that is PID controlled to the motor driver 76 based on the rotation speed of the driving roller 31*a* that is detected by the feeding rotation detection portion 43.

The intermediate motor control portion 83 drivably controls the intermediate motor 61 in PWM control via the motor driver 76. The intermediate motor control portion 83 outputs the duty value that is PID controlled to the motor driver 76 based on the rotation speed of the driving roller 33*a* that is detected by the intermediate rotation detection portion 63. The intermediate motor control portion 83 drivably controls the intermediate motor 61 such that tension is not applied to the printing medium P between the feeding roller 31 and the intermediate roller 33 in the line feeding operation.

The roll motor control portion 84 drivably controls the roll motor 51 in PWM control via the motor driver 76. The roll motor control portion 84 executes a computation process for obtaining a motor output value and outputs a calculated motor output value to the motor driver 76.

In the computation process, as shown in Formula (1), in detail, a motor output value Dx is obtained by subtracting Duty(f) that is a duty value (hereinafter referred to as "tension control value") that is necessary to give a predetermined tension F to the printing medium P between the intermediate roller 33 and the roll body R from Duty(ro) that is a duty value that is necessary for rotating the roll body R at a rotation speed V.

Equation 1

$$Dx = \text{Duty}(ro) - \text{Duty}(f) = a \times V + b - \frac{\frac{F \times r}{M}}{Ts} \times \text{Duty(max)} \quad (1)$$

Here, r is a radius of the roll body R, M is a reduction ratio according to the roll gear row 52, Duty(max) is a maximum value of the duty value, Ts is activation torque of the roll motor 51, and a and b are coefficients that are calculated by a measurement operation which will be described later. Note that, the radius r (roll diameter) of roll body R is calculated by a roll diameter calculation operation.

Figure 4:
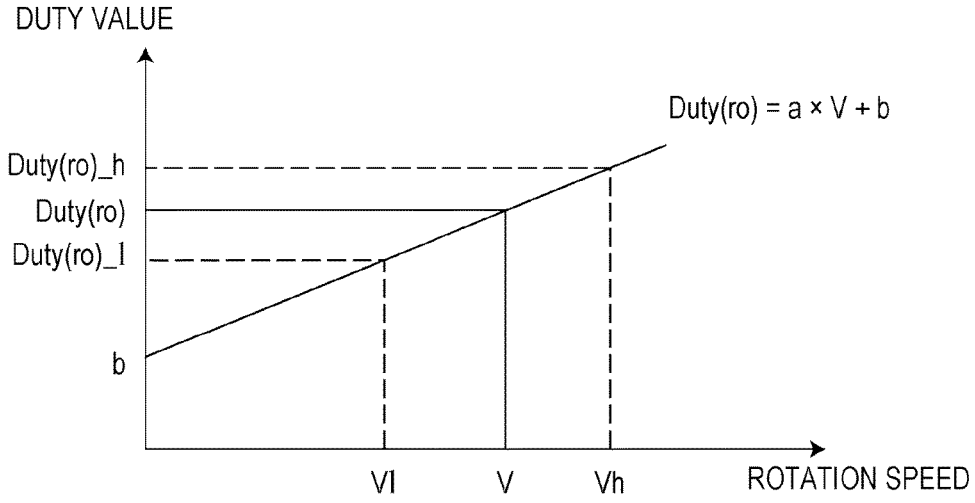
FIG. 4 is a graph illustrating a relationship between an arbitrary rotation speed V of the roll body and a duty value that is necessary to rotate the roll body.
Figure 5:
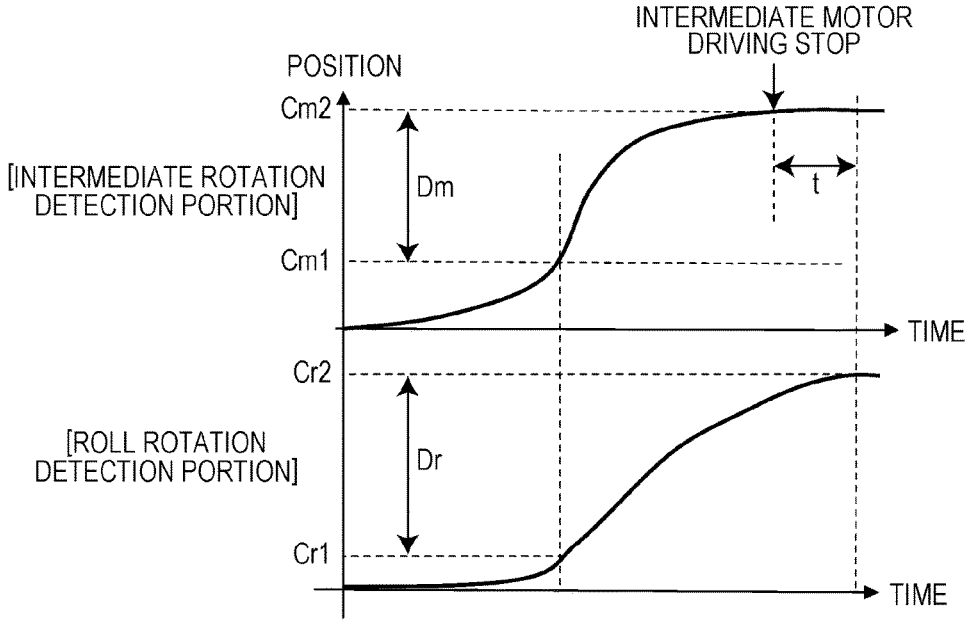
FIG. 5 is a graph illustrating a count value of a roll rotation detection portion and a count value of an intermediate rotation detection portion in a roll diameter calculation operation.

Here, the measurement operation and the roll diameter calculation operation will be described with reference to FIGS. 4 and 5. First, the measurement operation will be described with reference to FIG. 4. As shown in FIG. 4, the controller 13 drives the roll motor 51 such that the roll body R rotates at a low-speed rotation speed Vl in a state in which the intermediate motor 61 is stopped from driving. Then, the controller 13 acquires a duty value that is output to the roll motor 51 as Duty(ro)_l at a point of time when the rotation speed of the roll body R is stable at rotation speed Vl. Next, the controller 13 drives the roll motor 51 such that the roll body R rotates at a high-speed rotation speed Vh in a state in which the intermediate motor 61 is stopped from driving. Then, the controller 13 acquires a duty value Duty(ro)_h which corresponds to the high-speed rotation speed Vh in the same manner as during acquisition of the duty value Duty(ro)_l which corresponds to the low-speed rotation speed Vl.

It is possible to obtain simultaneous equations with respect to coefficients a and b by substituting the values in Formula (2).

$$\text{Duty}(ro)=a \times V+b \quad (2)$$

Coefficients a and b are determined by solving the obtained simultaneous equations and are reflected in Formula (1). Thereby, the measurement operation ends.

Next, the roll diameter calculation operation will be described with reference to FIG. 5. The roll diameter calculation operation calculates the radius r of the roll body R based on a count value of the roll rotation detection portion 53 and the intermediate rotation detection portion 63 when the printing medium P is fed by the intermediate roller 33. In detail, as shown in FIG. 5, the controller 13 drives the intermediate motor 61. Then, first, count value Cm1 of the intermediate rotation detection portion 63 is acquired at a point in time at which the count value of the roll rotation detection portion 53 is set to a predetermined count value Cr1. After that, the intermediate motor 61 is driven by a fixed amount, and then the driving of the intermediate motor 61 stops. Then, count value Cr2 of the roll rotation detection portion 53 and count value Cm2 of the intermediate rotation detection portion 63 are acquired at a point in time at which the set time t after stopping is exceeded. Note that, the set time t is a time from the intermediate motor 61 stopping until the rotation position of the roll body R is stabilized.

After two count values Cr1, Cr2, Cm1, and Cm2 are acquired by each of the roll rotation detection portion 53 and the intermediate rotation detection portion 63, the difference between each of the two count values are calculated and an amount of rotation Dr of the roll body R and an amount of rotation Dm of the intermediate roller 33 are acquired (rotation amount detection step). That is, as shown in Formula (3), the other count value Cr1 is subtracted from the one count value Cr2 that is obtained by the roll rotation detection portion 53 and the amount of rotation Dr of the intermediate roller 33 is acquired.

$$Dr=Cr2-Cr1 \quad (3)$$

In addition, as shown in Formula (4), the other count value Cm1 is subtracted from the one count value Cm2 that is obtained by the intermediate rotation detection portion 63 and the amount of rotation Dm of the intermediate roller 33 is acquired.

$$Dm=Cm2-Cm1 \quad (4)$$

In this manner, the amount of rotation Dr of the roll body R and the amount of rotation Dm of the intermediate roller 33 are detected when the printing medium P is fed by the intermediate roller 33. Note that, the "rotation amount detection portion" is constituted by the roll rotation detection portion 53, the intermediate rotation detection portion 63, and the controller 13. In addition, a "rotation detection step" is executed by acquiring each count value Cr1, Cr2, Cm1, and Cm2 and calculating the amount of rotation Dr of the roll body R and the amount of rotation Dm of the intermediate roller 33 are based on the values.

After the amount of rotation Dr of the roll body R and the amount of rotation Dm of the intermediate roller 33 are calculated, the radius r of the roll is calculated by substituting each calculated amount of rotation Dr and Dm in Formula (5) (roll diameter calculation step).

$$r=(\{Lm \times (Dm/Rm)\}/\{\pi \times (Dr/Rr)\})/2 \quad (5)$$

Here, Lm is an outer peripheral length of the intermediate roller 33, Rm is a count value of the intermediate rotation detection portion 63 when the intermediate roller 33 rotates once, π is a circular constant, and Rr is a count value of the roll rotation detection portion 53 when the roll body R is rotated once. Thereby, the roll diameter calculation operation ends.

Figure 6:
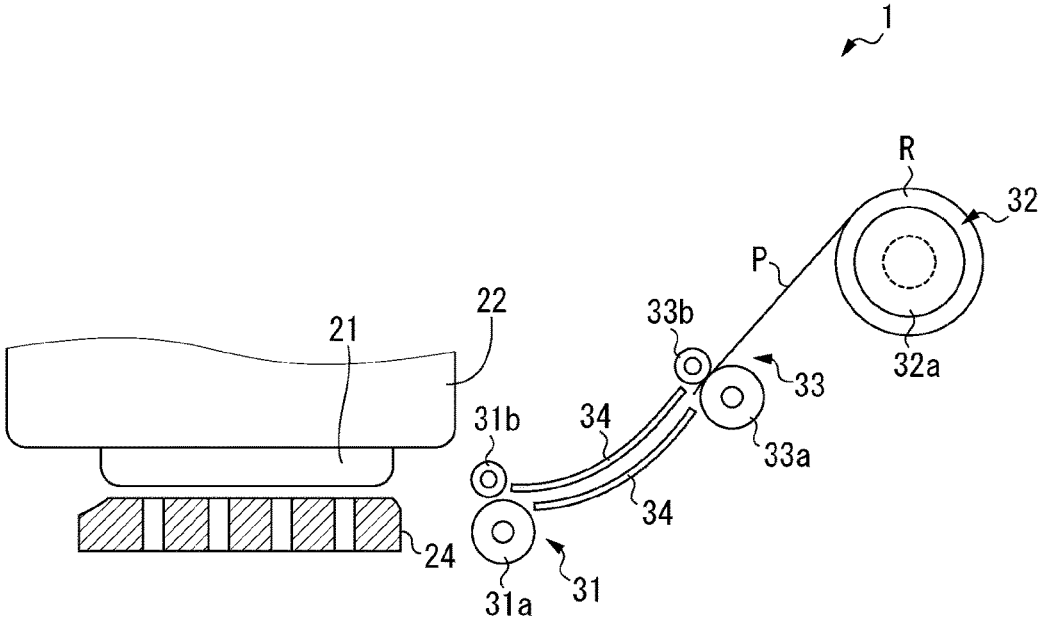
FIG. 6 is a first diagram illustrating a preparatory operation when setting the roll body.

In the present embodiment, it is possible to drivably control the roll motor 51 by the roll motor control portion 84 by performing the measurement operation and the roll diameter calculation operation when setting the roll body R. Therefore, a preparatory operation that is performed when the roll body R is set will be described with reference to FIG. 6 to FIG. 9. The preparatory operation is performed in a state in which the roll body R is set in the roll holding portion 32 and the tip end of the printing medium P that is pulled out from the roll body R is set in the intermediate roller 33 (refer to FIG. 6).

Figure 7:
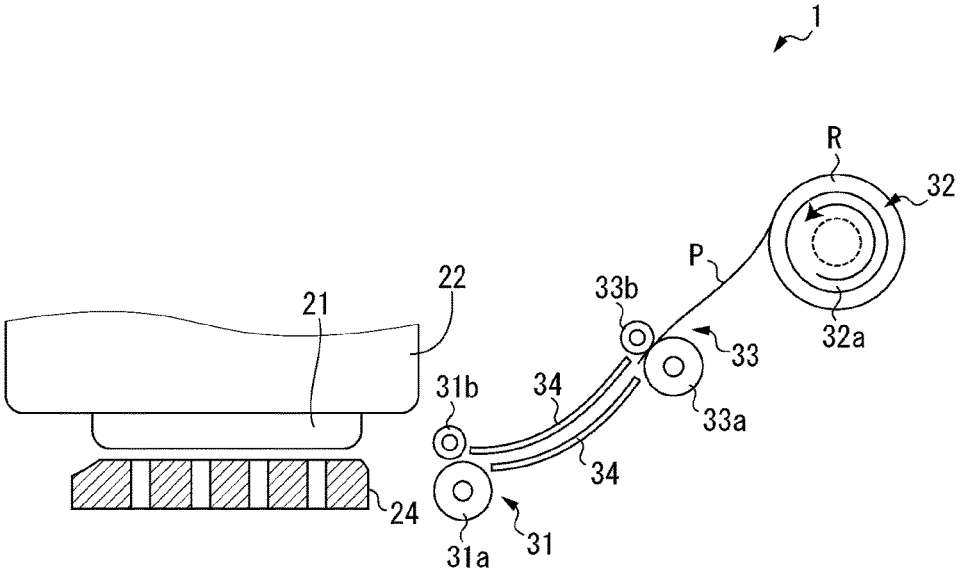
FIG. 7 is a second diagram illustrating the preparatory operation when setting the roll body.

In the preparatory operation, first, the measurement operation is executed (refer to FIG. 7). That is, the roll motor 51 drives so as to rotate the roll body R at the low-speed rotation speed Vl and acquires the duty value Duty(ro)_l which corresponds to the low-speed rotation speed Vl and the roll motor 51 drives so as to rotate on the roll body R at the high-speed rotation speed Vh and acquires the duty value Duty(ro)_h which corresponds to the high-speed rotation speed Vh. Then, the coefficients a and b are calculated based on the values.

Figure 8:
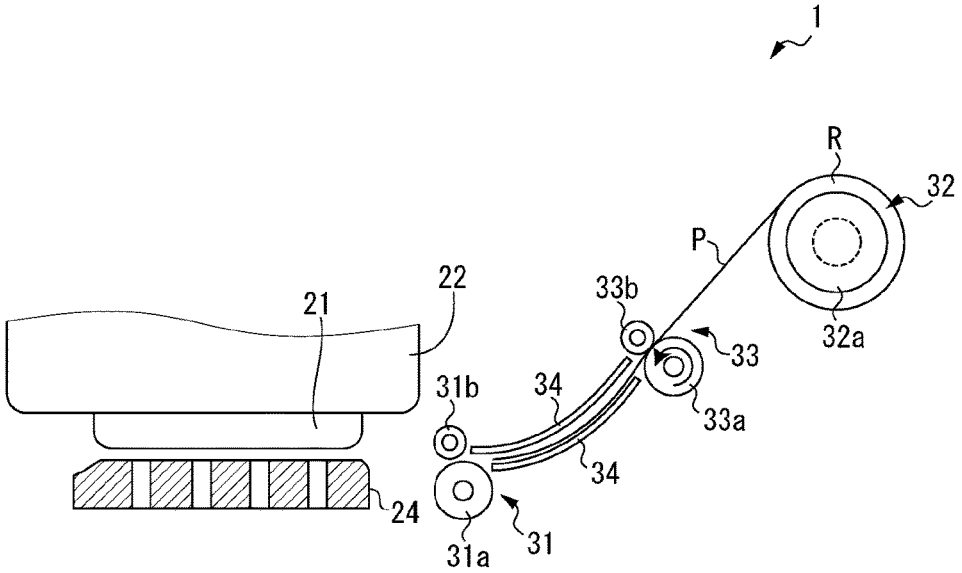
FIG. 8 is a third diagram illustrating the preparatory operation when setting the roll body.

After the measurement operation ends, the tip end of the printing medium P that is set on the intermediate roller 33 is fed on the feeding roller 31, and furthermore, a tip end feeding operation of feeding up to the downstream of the carriage 22 is performed, and the roll diameter calculation operation is executed during the tip end feeding operation (refer to FIG. 8). That is, the intermediate motor 61 drives and the count value Cm1 of the intermediate rotation detection portion 63 is acquired at a point in time at which the count value of the roll rotation detection portion 53 is set to a predetermined count value Cr1. After that, the intermediate roller 33 is driven by a fixed amount, then the driving of the intermediate motor 61 is stops, and count value Cr2 of the roll rotation detection portion 53 and count value Cm2 of the intermediate rotation detection portion 63 are acquired at a point in time at which the set time t after stopping is exceeded. Then, the amount of rotation Dr of the roll body R and the amount of rotation Dm of the intermediate roller 33 are calculated based on the values, and the radius r of the roll body R is calculated based on the amounts of rotation. Note that, during the tip end feeding operation, the driven roller 31*b* of the feeding roller 31 may be separated from the driving roller 31*a* such that paper feeding is not disturbed by the feeding roller 31.

Figure 9:
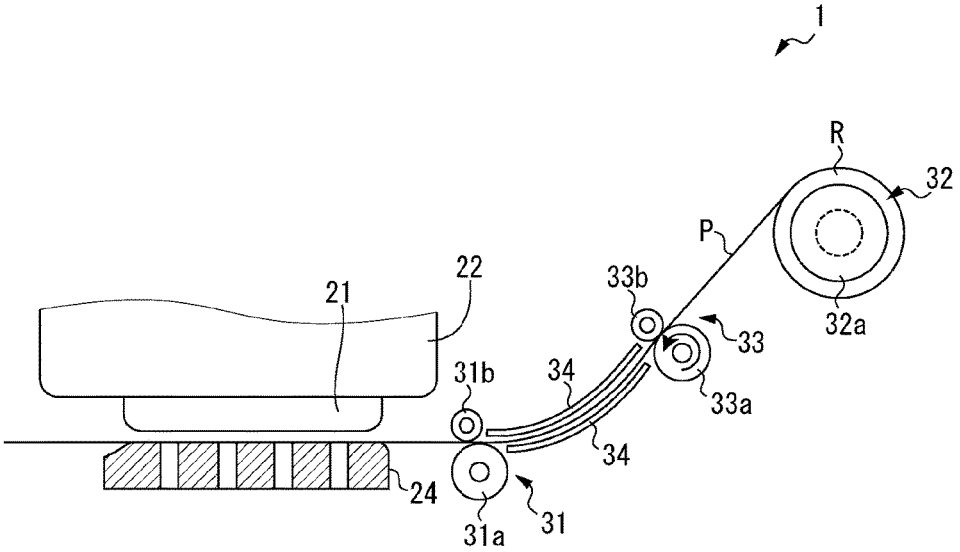
FIG. 9 is a fourth diagram illustrating the preparatory operation when setting the roll body.

After the roll diameter calculation operation ends, the intermediate motor 61 drives and the tip end of the printing medium P is fed to the downstream of the carriage 22 (refer to FIG. 9). Then, after the tip end of the printing medium P is fed to the downstream of the carriage 22, the paper width of the printing medium P is detected by a paper width sensor (omitted from the drawings) that is mounted in the carriage 22 and the preparatory operation ends.

According to the configuration in the manner of the embodiment described above, since there is a configuration in which the intermediate roller 33 is provided between the feeding roller 31 and the roll body R and the roll diameter is calculated using the amount of rotation Dm of the intermediate roller 33, it is possible to detect each amount of rotation Dr and Dm during a tip end feeding operation in which the tip end of the printing medium P that is set on the intermediate roller 33 is fed on the feeding roller 31, and it is possible to calculate the roll diameter. Consequently, it is possible to easily obtain a roll diameter with a simple configuration without performing a special feeding operation.

In addition, since there is a configuration in which the intermediate motor 61 drives and the amount of rotation of the intermediate roller and the amount of rotation of the roll body is detected from the point in time at which the feeding by the intermediate roller 33 starts and the roll body R rotates by a fixed amount, it is possible to detect the amount of rotation of the intermediate roller and the amount of rotation of the roll body after slack of the printing medium P between the intermediate roller 33 and the roll body R or backlash around the roll body R are eliminated. Therefore, it is possible to accurately calculate the roll diameter.

Note that, in the embodiment, in a case where the roll body R is not rotated by a fixed amount (in a case where the count value of the roll rotation detection portion 53 does not reach the predetermined count value Cr1) during the roll diameter calculation operation, it is preferable that there is a configuration in which the amount of rotation of the feeding roller 31 and the amount of rotation of the roll body R are detected when the printing medium P is fed by the feeding roller 31 and the roll diameter is calculated based on the detected amount of rotation of the feeding roller 31 and the amount of rotation of the roll body R. According to the configuration, it is possible to reliably obtain the roll diameter.

Note that, in the embodiment, when the printing medium P is fed by the intermediate roller 33 and the roll diameter is calculated (during the roll diameter calculation operation), in a state in which the roll motor 51 is stopped, there is a configuration in which only the intermediate motor 61 drives, but at this time, there may be a configuration in which the roll motor 51 drives and the roll body R rotatably drives in synchronization with the driving of the intermediate motor 61. In this case, Duty(ro) that is a duty value is obtained that is necessary for rotating the roll body R at the rotation speed V using the coefficients a and b that are obtained in the measurement operation, a predetermined proportion of the value is set as the motor output value Dx, and the roll motor 51 drives. According to the configuration, since it is possible to assist feeding by the intermediate roller 33 by using the roll driving portion 38, it is possible to reduce a load that is applied to the intermediate roller 33 during feeding by the intermediate roller 33. Consequently, it is possible to suppress slipping of the printing medium P on the intermediate roller 33, and it is possible to more accurately detect the roll diameter.

This application claims priority under 35 U.S.C. § 119 to Japanese Patent Application No. 2016-052974, filed Mar. 16, 2016. The entire disclosure of Japanese Patent Application No. 2016-052974 is hereby incorporated herein by reference.

What is claimed is:

1. A medium feeding apparatus comprising:

a feeding roller that feeds a medium;

a holding portion that holds a roll body on which the medium is wound;

an intermediate roller that pulls out the medium from the roll body and feeds the medium on the feeding roller;

a rotation amount detection portion that detects an amount of rotation of the intermediate roller and an amount of rotation of the roll body when the medium is fed by the intermediate roller; and a roll diameter calculation portion that calculates a roll diameter of the roll body based on the detected amount of rotation of the intermediate roller and the detected amount of rotation of the roll body, wherein the rotation amount detection portion detects the amount of rotation of the intermediate roller and the amount of rotation of the roll body during a tip end feeding operation in which a tip end of the medium that is set on the intermediate roller is fed on the feeding roller.

2. The medium feeding apparatus according to claim 1, wherein the rotation amount detection portion detects the amount of rotation of the intermediate roller and the amount of rotation of the roll body from a point in time at which feeding by the intermediate roller starts and the roll body is rotated by a fixed amount.

3. The medium feeding apparatus according to claim 2, wherein in a case where the roll body is not rotated by a fixed amount during the tip end feeding operation, the rotation amount detection portion detects the amount of rotation of the feeding roller and the amount of rotation of the roll body when the medium is fed by the feeding roller, and the roll diameter calculation portion calculates the roll diameter based on the detected amount of rotation of the feeding roller and the detected amount of rotation of the roll body.

4. The medium feeding apparatus according to claim 1, further comprising:

a roll driving portion that rotatably drives the roll body when the medium is fed by the intermediate roller.

5. A control method for the medium feeding apparatus, the apparatus including:

a feeding roller that feeds a medium;

a holding portion that holds a roll body on which the medium is wound; and an intermediate roller that pulls out the medium from the roll body and feeds the medium on the feeding roller, the method comprising:

detecting an amount of rotation of the intermediate roller and an amount of rotation of the roll body when the medium is fed by the intermediate roller; and calculating a roll diameter of the roll body based on the detected amount of rotation of the intermediate roller and the detected amount of rotation of the roll body, wherein detecting the amount of rotation of the intermediate roller and the amount of rotation of the roll body is performed during a tip end feeding operation in which a tip end of the medium that is set on the intermediate roller is fed on the feeding roller.

* * * * *